United States Patent [19]

Knight et al.

[11] 4,082,645

[45] Apr. 4, 1978

[54] RECOVERY OF HYDROCARBON VALUES BY CONTROLLED EDUCTION AND OXIDATION OF OIL SHALE

[75] Inventors: John H. Knight, Littleton; Lewis A. St. Cyr, Evergreen, both of Colo.; Omer L. Wilson, Houston, Tex.

[73] Assignee: The Superior Oil Company, Houston, Tex.

[21] Appl. No.: 750,409

[22] Filed: Dec. 14, 1976

Related U.S. Application Data

[63] Continuation-in-part of Ser. No. 567,546, Apr. 14, 1975, abandoned.

[51] Int. Cl.[2] ..... C10G 1/02

[52] U.S. Cl. ..... 208/11 R; 201/32

[58] Field of Search ..... 208/11 R; 201/8, 32

[56] References Cited

U.S. PATENT DOCUMENTS

| | | | |
|---|---|---|---|
| 2,560,767 | 7/1951 | Huff | 208/11 |
| 3,325,395 | 6/1967 | Ban | 208/11 |
| 3,483,115 | 12/1969 | Haddad et al. | 208/11 |
| 3,560,369 | 2/1971 | Rowland et al. | 208/11 |
| 3,644,193 | 2/1972 | Weggel et al. | 208/11 |

*Primary Examiner*—Delbert E. Gantz
*Assistant Examiner*—James W. Hellwege
*Attorney, Agent, or Firm*—Arnold, White & Durkee

[57] ABSTRACT

In the process for recovering energy values from oil shale by the cross-flow retort technique, an improvement is disclosed wherein controlled oxidation of non-vaporizable carbonaceous residue not only provides additional heat for the continuation of the oil educing process without application of external heat but also enables the continuation of a temperature profile which is below that at which adverse chemical and physical changes occur in the shale. According to the invention the moving bed is removed from exposure to external heat as soon as oil eduction has been completed in the upper bed regions. It is thereafter immediately exposed to unheated gases containing measured amounts of oxygen. Oxidation is initiated in those regions of the bed which are above about 800° F. The heat generated by such oxidation may be utilized, in place of externally heated gases, to transfer heat to the lower regions of the bed for oil eduction from those lower regions.

8 Claims, 2 Drawing Figures

RECOVERY OF HYDROCARBON VALUES BY CONTROLLED EDUCTION AND OXIDATION OF OIL SHALE

CROSS-REFERENCE TO RELATED APPLICATIONS

This application is a continuation-in-part of Ser. No. 567,546, filed Apr. 14, 1975, now abandoned.

BACKGROUND OF THE INVENTION

The present invention relates generally to methods for increasing the efficiency of cross-flow retort processes for recovering shale oil from oil shale.

In cross-flow retort processes for the recovery of oil values from shale, a flow of hot gases is forced through a gas-permeable moving bed of crushed shale particles (typical operations using, for example, a traveling grate of the type used in iron ore pelletizing). The hot gases cause thermal removal of the oil from the shale and conversion of the oil into vapor phase constituents. As these vapors are carried by the downdraft through the lower temperature regions of the bed, which are below the varporization point of the bulk of the oil, the oil is condensed to a liquid phase, yielding a fog or mist of suspended oil droplets in the otherwise gaseous medium. Separation of these oil droplets from the gas medium and condensation of the otherwise vapor phase oil constituents is carried on outside the cross-flow apparatus. The entire heating zone is kept sealed from exposure to the atmosphere in order to prevent loss by oxidation and/or burning of recoverable oil components.

The moving bed then travels to a second zone, where it is cooled by a cross-flow of incoming cool gas to recover sensible heat from the solids. The off-gas from the cooling zone may then be further heated and utilized as part of a preheating or heating operation. In some applications, the off-gas from the heating zone is passed through the incoming solids bed prior to the heating zone in order to preheat the bed and maximize the recovery of available sensible heat from the gas.

Depending upon such things as the type of shale used, the particle size and thickness of the bed, and the temperatures, time sequence, and number of recycle stages carried out in the retort process, inter alia, the spent shale discharged from a typical retort apparatus contains anywhere from about 0.5 to about 4% or more by weight of a carbonaceous residue, which is generally non-volatile and is fixed on the surface and within the pores of the spent shale particles.

The exact chemical nature of this residue is largely unknown, it being most probably a combination of carbon and high molecular weight hydrocarbons. The potential energy producing value of such carbonaceous material represents typically from about 5 to about 30% of the total organic heating value of the shale.

Attempts at recovery of this carbonaceous residue would be worthwhile, if for no other reason than its organic heating value. Just as important, however, is the fact that the presence of this residue interferes substantially with the convenient and economic recovery of other mineral values (most importantly, aluminum) from the spent shale particles. For example, the high organic materials contained in such residue create problems in wetting the shale particle, produce unwanted foaming and also are a source of contamination of any recovered products. The carbonaceous residue thus must either be removed from the particles before further processing or the particles ground to a finer state in order to expose more surface area to the chemical processes which effect the removal of aluminum. In any event, removal of the organic materials in the aluminum recovery process presently requires additional expensive equipment.

It has been proposed in the prior art to recover the energy value of this residual carbonaceous material by outright combustion of the residue. The heat of combustion may then be utilized in providing heat to the initial stages of the retort process. However, the high temperatures inherent in such a procedure create their own problems.

For example, it is known that at temperatures of about 1600° F, the softening point of some of the minerals contained in the shale ash is reached and sintering occurs, resulting in what are known as "clinkers." Needless to say, when sintering occurs, additional physical treatments are required in processing the shale ash for recovery of mineral values.

More critically, temperatures in excess of 1400°–1500° F produce chemical and physical changes in the shale ash which result in the aluminum and sodium values no longer being removable by convenient leaching techniques.

Finally, at about 1350° F, a number of chemical reactions which are endothermic in nature begin to occur. Even where recovery of aluminum, magnesium or sodium by further processing of spent shale is not contemplated, these endothermic reactions still represent a considerable waste of energy.

Heretofore, it has not been apparent that oxidation of the carbonaceous residue on the spent shale particles could be controlled. The difficulty lies in providing a system which would balance the introduction of heat to the burden so that the bed is neither overheated nor over-cooled. The undesirable effects caused by overheating have been previously explained. A minimum temperature is also important since if the particles are cooled before essentially all of the carbonaceous material thereon is removed, the oxidation reaction is quenched when the surface at which the reaction is occurring falls below the ignition temperature.

It is a primary feature of the present invention that overall thermal efficiency of the retorting process is increased while at the same time economically feasible utilization of the total mineral content of oil shale can be realized.

SUMMARY OF THE INVENTION

According to the present invention, substantially all of the carbonaceous residue in spent shale may be effectively oxidized, without the undesirable results of combustion, by means of a sustained, controllable process at temperatures as low as 800° F. This controlled oxidation reaction takes place during the retort operation itself, thus eliminating the need for any subsequent processing of the shale or shale ash, other than to recover non-carbonaceous mineral values therefrom. Further, the invention process utilizes the exothermic oxidation reaction as a primary source of the heat necessary to initially raise the shale bed to oil-educing temperatures and break down the higher molecular weight hydrocarbons for easier recovery.

The present invention may be characterized broadly as an improvement in the so-called retort process for recovering energy values from oil shale. Previously heated reducing or inert gases are passed in cross-flow fashion through a moving, quiescent bed of crushed shale in a direction normal to the direction of travel of the bed. That portion of the shale bed facing the gas inlet and which is initially contacted by the hot gases is heated to oil-educing temperatures. The gases strip the oils from the shale particles, leaving a non-vaporizable carbonaceous residue in the spent shale.

According to the invention, the hot gases are passed through the moving bed at a temperature and flow rate such that by the time a zone is created wherein only a portion of the layers of shale particles at the gas inlet side of the bed are heated to oil-educing temperatures, a temperature profile is established within the bed which is below those temperatures at which adverse chemical and physical reactions involving the spent shale would occur.

As the moving bed passes from the first retorting zone, and while the spent shale particles at the gas inlet side of the bed remain above oil-educing temperatures, the bed is transferred to a second zone wherein heat is produced and transferred to the deeper regions within the bed, in order to complete oil reduction from those regions, by means of a controlled oxidation of the carbonaceous residue in the spent shale regions of the bed. Oxygen-containing gases are directed through the bed in the same direction as the hot gases of the first zone. The oxygen mass flow rate initially contacting the bed is preadjusted to take into account the existing temperature of the spent shale and produce a sustained combustion of the carbonaceous residue without raising the temperature of the bed above the established range. Thereafter, the oxygen flow rate is incrementally adjusted such that as the bed proceeds through the second zone, the carbonaceous residue in the remaining portions of the bed continues to be oxidized down to the gas outlet portion of the bed, while at the same time the established temperature profile of the bed is maintained.

Ultimately, the point will be reached when the bed will have been permeated with oxygen and substantially no further carbonaceous residue is available for oxidation and the accompanying generation of heat. Downstream from this point the bed will continue to cool as lower temperature cooling gases are downdrafted through it.

DETAILED DESCRIPTION OF THE INVENTION

Figure 1:
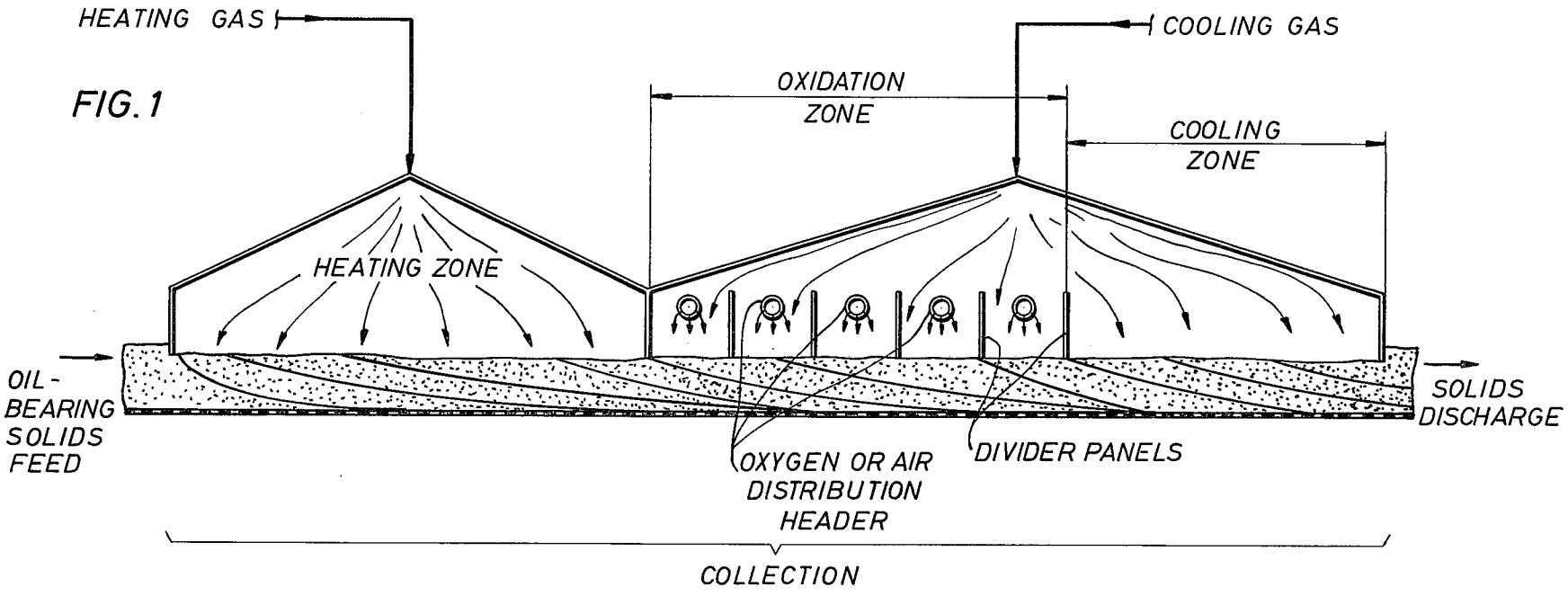
FIG. 1 is an illustrative representation of the process of the present invention showing, in cross section, shale temperature and oxidation region profile lines which are generated within a moving shale bed according to the invention. A representation of the apparatus for carrying out the process of the present invention is included to indicate approximate on-stream locations of the various profiles.

The present invention is carried out utilizing a conventional traveling grate retort apparatus, which may be either circular or straight line in operation, as will be understood by those skilled in this art. Typical of such commercially available apparatus are those manufactured by Arthur G. McKee & Co. and McDowell-Wellman Engineering Co., both of Cleveland, Ohio. In such apparatus, a moving, quiescent, gas-permeable bed of solid particles is formed on a traveling grate which carries the bed horizontally through the device. By "moving quiescent" is meant that once the bed is formed and is moving along a predetermined path, there is minimal relative movement between adjacent particles.

Hoods and wind boxes are disposed respectively above and below the traveling grate to define chambers or zones within which a fluid cross-flow is provided through the bed. The hoods and wind boxes preferably are sealed to prevent entry of atmospheric air into, or loss of heat or material from, the chambers or zones. The use of unidirectional and uniform gas flow in each zone of the cross-flow device is recommended. This will result in the same pressure profile being produced in each zone as well as a zero pressure differential between the zones from top to bottom of the bed. Interzone leakage will thereby be reduced or eliminated, thus reducing the space between adjacent zones required for seals.

The moving bed proceeds through one or more heating zones in which hot reducing or neutral gases are passed through the bed, heating the shale until oil-educing temperatures are reached. As is well known, temperatures above about 800° to 1000° F. are required to begin decomposition of the kerogen, the organic, waxy constituent in oil shale, to yield the hydrocarbon substances having properties resembling crude oil components. The heated kerogen breaks down into vapors which become condensed and suspended in the gas stream as it passes through the bed. After passing through the moving bed, the gases are collected and passed through a separator, for example a cyclone separator, scrubber, electrostatic precipitator, or the like, where oil is condensed and separated from the gas. Those oil-depleted gases which are essentially oxygen-free may conveniently be recycled within the system, and may be preheated, e.g., by passing them through the solids cooling zone, as will be well understood in the art.

In the present invention, hot gases are passed through a moving, quiescent bed of shale particles in a direction which is normal to the direction of travel of the bed. With a horizontally traveling bed, either updraft or downdraft passage may be utilized. However it has been found that a more advantageous system may be expected from having the gases pass through the bed in all zones in a downdraft fashion and the remainder of this discussion will assume such a system.

The downdraft of hot gases, which gases may be either reducing or inert and are preferably above 1000° F. but necessarily below about 1500° F., is continued until at least a portion of the top layers of shale reaches a temperature in the order of 800°–1000° F.

In conventional oil shale cross-flow retorting operations, the oil shale remains in the heating or retort zone until all of the solids have been brought to the desired retorting temperature and maintained at that temperature until eduction has taken place. When the entire bed has been brought up to the proper temperature and the efficient eduction of oil has been completed, the bed is directed to a cooling zone. In this zone, gases which have not been heated, but which may be as not as 150° F. or more, are passed through the bed, preferably in downdraft direction and preferably at the same pressures as the preceding hot gas drafts, for recovery of the sensible heat within the bed prior to subsequent treatment of the spent shale. The gases as they leave the bed are at higher temperatures because they have absorbed heat from the shale. These hotter gases may conveniently be used either to preheat the bed or, with the addition of external heat, as heating gases for the retorting operation.

It is a feature of the present invention that the moving bed may be passed from the initial retorting zone into the cooling zone before the solids at the bottom layers of the bed have reached the desired retorting temperature. The hot, spent shale particles at the top of the bed as it enters the cool gas zone have been essentially completely stripped of vaporizable hydrocarbon energy values. The temperature of the particles in such top portion of the bed should approach that of the hot gases used in the heating zone, i.e., between about 800° to about 1500° F.

In accordance with the invention, a measured amount of oxygen gas is included in the cool gases initially directed at the bed so as to establish a controlled rate of oxidation of the carbonaceous material in the bed and, thereby, the rate of heat generation necessary to maintain the established temperature profile. The amount of oxygen may be predetermined empirically in relationship with the expected amount of carbonaceous residue contained in the bed and also the temperature of the bed. It has been found that it is necessary for at least the top portion of the bed to be above about 800° F. in order to ignite a sustained but controllable combustion of the carbonaceous residue.

The percentage, or concentration, of the oxygen contained in the gases initially directed at the uppermost portions of the bed will be determined by a number of interrelated factors. Among these are, for example, the mass flow rate and specific heat of the gases, the depth and travel speed of the bed and the average particle size and temperature of the topmost layers of the bed. It will be apparent to those skilled in this art that these factors and other obvious factors will have to be taken into account. If there is too little oxygen in the gases initially passed through the zone, oxidation will take place too slowly and the bed will begin to cool rather than heat, thus bringing the bed particles below the combustion ignition temperature and stopping the oxidation reaction. Too much oxygen, on the other hand, will result in too high a rate of combusion, resulting in excess temperatures and loss of process efficiency. It has been found that with conventional throughputs, as low as one-half of one percent by weight oxygen is sufficient to start the progression of the heat front through the bed at the initial cooling stage.

Thus, in the operation of the present invention, the initial stages of a cooling zone may serve as continuing retort stages. The hot particles in the bed provide in the first place sensible heat to the incoming cool gas. This sensible heat is transferred to the gas and carried down through the bed to bring the shale particles in the lower layers of the bed to higher temperatures. Additional heat is transferred to the gas and carried down through the bed as a result of oxidation of the carbonaceous residue in the spent shale particles at the top of the bed. Thus, the final heating of the lower portions of the bed takes place at the same time and at the same location along the solids path as does the initial cooling and oxidation of the upper portion of the bed. The heavy oil products from the shale in this area of the device are educted and collected in a manner similar to that described above for the products educed in the heating zones. Routine empirical calculations will determine when the top layers of the bed are ready to be transferred from the heating zone to the combined cooling and oxidation zone. It is of course a necessary feature of the invention that the cooling gases initially hitting the surfaces of the uppermost layer of particles contain sufficient oxygen to cause oxidation of the carbonaceous residue on the surface of the particles in said uppermost layer. As the bed proceeds through the early stages of the combined oxidation-cooling zone, the amount of oxygen contained in the gases initially drafted through the uppermost layers of the bed should be controlled and varied, if necessary, only enough to cause sufficient oxidation to control the temperature of the bed so as to maintain the same temperature profile as was established in the heating zone.

Thus a continuing oxidation front is created within the moving bed, continuing the temperature profile which was established in the first zone, and permitting the efficient removal of the carbonaceous residue from the shale particles. As this front proceeds through the cooling zone, the topmost surfaces of the shale bed become depleted of carbonaceous residue and soon begin to be cooled by the lower temperature gases. In order to control the moving front and maintain its temperature profile, the oxygen concentration at downstream locations must first be increased in order to assure that enough oxygen reaches the ever-descending point in the bed at which carbonaceous residue remains. Later on, as the incoming gases begin to absorb heat not only from the energy of the oxidation reaction but also from the upper layers of the shale bed itself, the temperature profile in the bed must be controlled by decreasing the oxygen concentration in the gases, thereby reducing the rate of energy generation by oxidation. Alternatively, the heat absorbing rate of the gas may be increased through an increase in the gas flow rate. This alternative is less desirable since it results in a different pressure drop across the bed and possible interzone leakages.

In general, bed temperature can be controlled by controlling the reaction rate, which is a function of both driving force and resistance to reaction. The overall resistance to reaction has been mathematically expressed and molded by experimental test-work. These resistances include resistance to mass transfer, i.e., resistance to diffusion of the oxygen through each particle of spent shale to the reaction surface. It can be appreciated that the resistance to the reaction increases with time, which is predominantly influenced by the progressively thicker solid shale or "ash layer" surrounding each shale particle and the progressively smaller surface area of the shrinking core at which the oxidation reaction takes place. As the resistance increases, the oxygen concentration in the gas phase should be controlled to establish a controlled rate of reaction versus time. Thus, bed temperature is controlled by matching reaction rate with cooling capacity of the gases.

As the bed proceeds through the cooling zone, the oxidation of the carbonaceous materials in the uppermost layer results in the generation of heat. This heat, in addition to the heat already present in the particles, is transferred directly to the cool gas stream which in turn transfers heat to the next lower layers of particles in the bed. When the uppermost layers in the bed are depleted of carbonaceous material, they no longer generate heat but begin to cool. This results in the formation of a boundary line forward of the moving oxidation front defining an area in the bed of carbon-depleted spent shale. (See "D" in FIG. 2.) When this occurs, in order to maintain the temperature profile of the bed, additional oxygen must be added to the incoming gases to provide additional oxidation and, thereby, additional heat. The increment necessary, as well as the location in the cooling zone at which such additional oxygen will be added, may be determined empirically. It has been found that for most bed size, bed depths, and gas flow rates, the oxygen should be kept within the range 0.5 to about 11% by weight of total cooling gas. At percentages above about 12% $O_2$, too much heat is given off and cool gas flow rates required to control bed temperatures become uneconimical due to excessive pressure drops. The cooling capacity of the gases must be balanced with the total heat being provided by the shale (sensible as well as that produced by oxidation of residual carbon materials). Otherwise, the controlled effect of the process is lost. In order to assist in providing for a clear demarcation within the cooling zone of inner stages wherein the downdrafted gases contain differing percentages of oxygen, baffles may be provided and/or the oxygen distribution headers otherwise disposed as close to the top of the moving bed as possible.

Addition of oxidizing gases to the cooling gases is continued until the point is reached where the carbonaceous residue has been reduced to such a level that it is uneconomical to continue or is removed from essentially all of the particles in the bed. In some retort applications, oxygen breakthrough at the bottom of the apparatus will govern the point at which oxidation is stopped. Typically, this will result in approximately 60% overall removal of carbonaceous residue. Cooling continues past this point as in the prior art in order to cool the bed.

In accordance with one embodiment of the invention, illustrated in cross-section in FIG. 1 of the attached drawing, particles of mined, crushed oil shale are deposited on a traveling grate to form a bed 4 to 10 feet deep. The preferred particle size will be from about ¼ inch to about 6 inches in diameter. It will be understood that greater or lesser particle sizes and bed depths may be used in the method of this invention, such variations affecting the heating or cooling time necessary as well as the pressure drop of the heating or cooling fluid through the solids bed. Particle sizes as large as 18 inches have been used as well as bed depths up to 10 feet or more. Typically, the width of the grate pallets in commercially available apparatus is from 9 to 20 feet.

The bed is continuously formed at the solids inlet, moved through the apparatus and into and through a plurality of processing zones wherein respective cross-flows of hot and cool gas are provided to heat and cool the particles. The most favorable conditions for carrying out the improvement of the invention require a bed which is relatively uniform in depth and where particle sizes are distributed in layers (large on top, small on bottom). The charge on the grate is desirably segregated in layers to place the larger particles near the top of the bed where they will be subjected to the longest periods of high temperature heat. Smaller particles are preferably disposed adjacent to the grate surface. Of course this will require an additional processing step which may not be economically justified in all circumstances. As an acceptable alternative, the average particle size should be kept as uniform as possible throughout the bed and the range of particle sizes as narrow as possible.

Movement of the grate carries the bed first into a high temperature zone wherein hot gas is directed downwardly through the bed, normal to the direction of movement of the bed. The gas is heated to a temperature between about 1000° to 1400° F. by an external heater. As the bed moves through the heating zone, the oil shale particles at the gas inlet side of the bed are heated by the hot gas. This transfer of heat to the uppermost layer of particles results in a cooling of the gas, thus reducing the driving force for heat transfer to the lower particles. As the solids move through the heating zone, the uppermost particles become fully heated. Thereafter, the incoming hot gases move on downward without any initial loss of heat to heat the lower particles in the bed. A temperature profile, such as is illustracted in FIG. 2 of the attached drawing, is soon developed within the moving bed.

Figure 2:
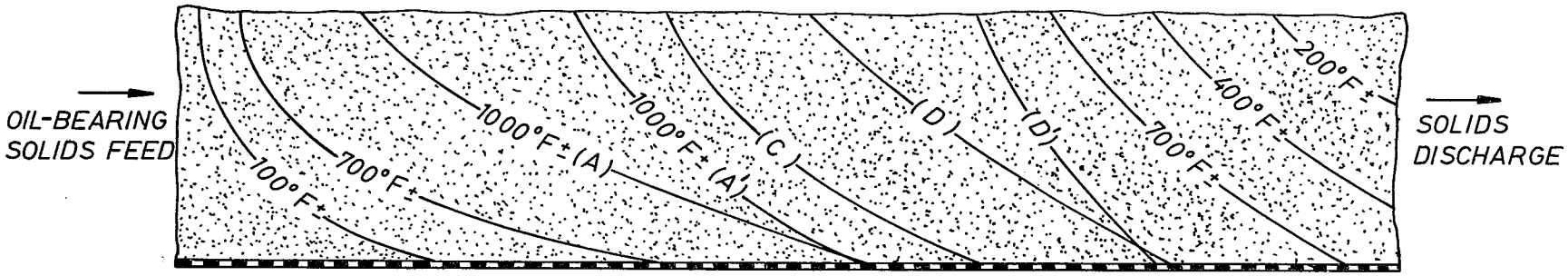
FIG. 2 is a detail of the shale temperature and oxidation region profile lines of the bed which is illustrated in FIG. 1.

As can be seen with reference to FIG. 2, very shortly after the bed enters the heating zone, a region is created within the bed at which the particles have been heated to between about 700° and about 1000° F. Oil eduction takes place within this region. Below this region, the temperature within the bed falls off until at the very bottom of the bed the particles have essentially not been heated. The temperature profile lines shown in FIG. 2 represent those which would occur if only essentially one particle size existed in the bed, and are therefore somewhat ideal. Lines A′ and D′, on the other hand, illustrate the longer initial heating and oxidation times which would be necessary were the bed stratified with progressively larger particles on the topmost (gas inlet) side.

As the bed proceeds through the heating zone, two things occur: First, the region within the bed at which oil eduction takes place, i.e., that region where the particle temperatures are in the range 700° to 1000° F., progresses lower and lower within the bed. Second, a new region is created, that where oil eduction has been essentially completed. In this region, shown in the drawing as that between profile lines A (A′) and C, the particles have had sufficient residence time at oil educing temperatures so that essentially all of the vaporizable hydrocarbon materials within and on the particles have been stripped therefrom.

Since those particles at the top of the bed are exposed to the heating gases for the longest residence time, the region of essentially complete oil eduction occurs first at the top layers of the bed. It is at this time, while the particles in such portion of the bed remain at temperatures above about 800° F., that the bed is transferred directly from the heating zone to a second zone, wherein gases which have not been externally heated and are about 200° F. are drafted downwardly through the bed.

In the initial stages of this second zone, the gases initially directed at the hot particles at the surface of the bed are mixed with oxygen. This may be accomplished by providing a series of air inlet ports adjacent to or below the cooling gas ports in the hoods over the bed. As shown in the drawing, the preferred technique is to install a series of air distribution headers laterally across the apparatus, each header separated from the adjacent ones by divider panels, thus creating a series of oxidation stages within the cooling zone. The amount of oxygen added to the gases is adjusted depending upon those variables previously discussed, (such as the rate at which the bed is moving, the temperature of the upper layer of particles within the bed, the inlet gas temperature and the gas flow rate) so as to cause oxidation to occur of the nonvaporizable carbonaceous material retained in and on the spent particles and to cause such oxidation to take place at a controlled rate which matches the heat absorbing capacity of the gases entering the bed.

Oxidation of the carbonaceous materials is, of course, an exothermic reaction, whereby heat is generated. This heat is transferred directly by conduction to those regions of the bed immediately adjacent to (generally below) that wherein oxidation is taking place. It is also transferred to the gases passing downwardly through the bed. By such means, the temperatures of the lower regions of the bed continue to rise until, ultimately, oil educing temperatures are also reached in these lower regions. By controlling the amount and rate of oxidation, the temperature profile which has been initiated in the heating zone of the retort apparatus may be continued. As oil eduction takes place in the lower regions, the retort operation, i.e., vaporization, condensation and collection of the oil particles, also continues as it did in the heating zone. When the two zones are immediately adjacent each other, the same collection and separation apparatus may be used.

As the bed progresses through those stages of the cooling zone wherein oxygen-containing gases are passed downwardly through the bed, progressively lower regions of the bed become oxidized, generate heat and transfer this heat to adjacent regions within the bed. At predetermined stages downstream from the initial entry of the bed into the retorting portion of the oxidation-cooling zone, incremental increases are made in the amount of oxygen contained in the gases. This incremental addition of increasing amounts of oxygen is required to assure that the oxidation taking place within the bed is maintained at the appropriate rate. After oxidation has been carried out within a given region of the bed for an initial period of time, the shrinking of the core of carbonaceous material within each shale particle results in an increased resistance to mass transfer of oxygen through the progressively thicker ash layer on the surface of the particle. Thus, an incremental increase in the mass flow rate of oxygen is necessary to offset the increased resistance. A secondary reason for increasing the mass flow rate of oxygen is that the actual rate of oxidation must be increased as the upper regions of the bed become essentially depleted of oxidizible carbonaceous material. This is the portion of the bed illustrated in FIG. 2 which is forward of profile line D (D'). As these upper regions begin to cool, an ash layer begins to form, causing the gas diffusion resistance to increase and the area available for oxygen transfer to decrease, at this point, an appropriate increase in oxygen (Driving force) is needed to keep the mass transfer rate of $O_2$ to the reaction interface in balance. A controlled increase in $O_2$ is required to assure that the temperature profiles in the lower regions are maintained.

As mentioned above, care should be taken to prevent the higher levels of oxygen at down-stream locations in the retorting section of the cooling zone from entering the bed at too early a stage. This can be accomplished by any convenient means, such as for example, placing the oxygen distribution headers as close to the bed as feasible and providing for a series of baffles between the stages of different oxygen content.

Just as it is necessary to increase oxygen content in the early stages of the oxidation-cooling zone, so also it may be necessary to decrease oxygen content, i.e., the mass flow rate of oxygen, near the latter end of the oxidation stages. The buildup of sensible heat in the shale bed as a result of earlier oxidation reactions may combine with the heat generated by further oxidation to exceed the cooling capacity of the gases. Thus, in order to prevent over-heating of those lower portions of the bed where oxidation is yet occurring, it may be necessary to lower the concentration of oxygen in the cooling gases. Of course, it should be apparent that an alternative method of increasing the cooling capacity of the gases is to increase the gas flow rate.

The foregoing description of the invention has been directed in large measure to a particular preferred embodiment in accordance with the requirements of the Patent Statutes and for purposes of explanation and illustration. It will be apparent, however, to those skilled in this art that many modifications and changes in both apparatus and procedure may be made without departing from the scope and spirit of the invention. For example, as referred to earlier, the draft of gases through the moving quiescent bed may be in updraft, rather than downdraft fashion, with appropriate changes in vapor collection apparatus. Also, the oxygen addition procedure has been set forth as a modification of existing cooling gas zones. Should it be convenient or desired, oxidation may be carried out in a totally separate zone. As a final example, while the changes in mass flow rate of oxygen have been indicated as being accomplished by changing the concentration of oxygen within the gases, equivalent incremental changes in mass flow rate may be effected by changes in the gas velocity. These and other modifications of the invention will be apparent to those skilled in this art. It is Applicants' intention in the following claims to cover all such equivalent modifications and variations as fall within the true spirit and scope of the invention.

What is claimed is:

1. In the process for recovering oil from oil shale wherein hot reducing or inert gases are passed in cross-flow fashion through a moving quiescent bed of crushed shale in a direction normal to the direction of travel of said bed to heat the shale particles in said bed to oil-educing temperatures and strip the oils from the shale, leaving a non-vaporizable carbonaceous residue in the spent shale, the improvement which comprises:

in a first zone, passing hot reducing or inert gases through said moving bed at a temperature and flow rate sufficient to heat only a portion of the layers of particles at the gas inlet side of the bed to oil educing temperatures and to establish within said bed a temperature range below that at which adverse chemical reactions involving the shale would occur;

thereafter, prior to the time when the particles in those regions of the bed which are farthest from the gas inlet side have reached oil-educing temperatures but while the particles at the gas inlet side remain above oil educing temperatures, transferring said bed to a second zone;

in said second zone, directing oxygen-containing gases through the bed from said gas inlet side, whereby a substantial portion of the carbonaceous residue in the spent shale regions of the bed is oxidized, producing and transferring heat to the deeper regions within said bed, the oxygen mass flow rate of said oxygen-containing gases being initially set and thereafter incrementally adjusted at downstream locations such that as the bed proceeds through said second zone, the carbonaceous residue in the remaining portions of the bed continues to be oxidized through to the gas outlet side of the bed while at the same time the temperature profile of the bed is maintained within the temperature range established in the first zone.

2. The shale oil recovery process of claim 1 wherein the gases are downdrafted through the bed in each zone and the pressure drop through the bed is maintained essentially the same in each zone.

3. The shale oil recovery process of claim 1 wherein the moving quiescent bed of crushed shale is stratified with the larger particles of crushed shale at the gas inlet side of the bed and the smaller particles proximate to the gase outlet side.

4. A process for the substantial recovery of organic heating values from shale which does not result in a significantly adverse effect on the subsequent processing of the shale to recover solid minerals therefrom, which process comprises the steps of:

forming a moving, quiescent, gas permeable bed of crushed shale particles on a traveling grate;

directing said moving bed into a first zone wherein hot reducing or inert gases having a temperature of from about 800° to about 1500° F. are drafted through said bed in a direction which is normal to the direction of travel of the bed;

maintaining the residence time of said bed in said first zone long enough to create in said bed only adjacent the gas inlet surface of said bed a region wherein the shale particles have been heated to oil educing temperatures and to establish within the bed a temperature profile which is below those temperatures at which adverse reactions involving the shale would occur;

stripping and recovering substantially all of the vaporizable hydrocarbon materials from the particles in said region; and thereafter directing said moving bed while it remains hot into a second zone wherein oxygen-containing gases which have not been heated are drafted through said bed, the amount of oxygen in the unheated gases being sufficient to cause oxidation of the non-vaporizable carbonaceous material retained on and in those particles in said region from which the vaporizable materials have been stripped and to cause such oxidation to take place at a controlled rate which matches the heat absorbing capacity of the gases entering the bed;

whereby further heat is generated and transferred to the gases passing through said bed, thus raising the temperatures of the deeper regions within the bed until oil educing temperatures are reached in said regions of said bed;

incrementally changing the mass flow rate of oxygen in the unheated gases directed at the bed at predetermined locations downstream from the initial entry of the bed into said second zone as necessary to correspond to the additional heat required to be generated as progressively deeper regions of said bed are oxidized, and to maintain the temperature profile within the bed.

5. The process as in claim 4, wherein the residence time of the bed in the first zone is minimized by transferring the bed directly to the second zone as soon as that portion of the bed adjacent the gas inlet surface has reached a temperature above about 800° F.

6. The process as in claim 4, wherein the heated and unheated gases are downdrafted through the bed and the pressure drop through the bed is maintained essentially the same in each zone.

7. The process as in claim 4, wherein the moving quiescent bed of crushed shale is stratified with the larger particles of crushed shale at the gas inlet surface of the bed and the smaller particles proximate to the gas outlet surface.

8. The process as in claim 4 wherein the oxygen-containing gases are directed through said bed at flow rates sufficient to permit cooling of the hydrocarbon depleted regions of the bed at the same time as oxidation is occurring in the deeper regions of the bed.

* * * * *

UNITED STATES PATENT OFFICE

CERTIFICATE OF CORRECTION

Patent No. 4,082,645 Dated April 4, 1978

Inventor(s) John H. Knight et al.

It is certified that error appears in the above-identified patent and that said Letters Patent are hereby corrected as shown below:

Column 1, line 24, "varporization" should read -- vaporization --.

Column 4, line 63, "not as 150°"should read -- hot as 150°--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*